US005984026A

United States Patent [19]

Bækken et al.

[11] Patent Number: 5,984,026

[45] Date of Patent: Nov. 16, 1999

[54] PRESSURE CONVERTER

[75] Inventors: Asbjørn Bækken; Tore Andersen; Sigmunn Strøm, all of Kongsberg, Norway

[73] Assignee: Den Norkse Stats Oljeselskap A.S., Stavanger, Norway

[21] Appl. No.: 08/913,992

[22] PCT Filed: Mar. 5, 1996

[86] PCT No.: PCT/NO96/00050

§ 371 Date: Mar. 30, 1997

§ 102(e) Date: Sep. 30, 1997

[87] PCT Pub. No.: WO96/30618

PCT Pub. Date: Oct. 3, 1996

[30] Foreign Application Priority Data

Mar. 31, 1995 [NO] Norway ..... 95 1272

[51] Int. Cl.[6] ..... E21B 4/02

[52] U.S. Cl. ..... 175/93; 175/324

[58] Field of Search ..... 175/67, 93, 95, 175/107, 324

[56] References Cited

U.S. PATENT DOCUMENTS

| | | | |
|---|---|---|---|
| 4,047,581 | 9/1977 | Erickson | 175/95 |
| 5,246,080 | 9/1993 | Horvei et al. | 175/93 |
| 5,375,671 | 12/1994 | Horvei | 175/93 |

FOREIGN PATENT DOCUMENTS

| | | |
|---|---|---|
| 0 335 543 | 10/1989 | European Pat. Off. . |
| 169088 | 5/1992 | Norway . |
| 171322 | 2/1993 | Norway . |
| 171323 | 2/1993 | Norway . |
| 171325 | 2/1993 | Norway . |
| 91/07566 | 5/1991 | WIPO . |
| 92/08871 | 5/1992 | WIPO . |
| 92/08872 | 5/1992 | WIPO . |

*Primary Examiner*—William Neuder
*Attorney, Agent, or Firm*—Foley & Lardner

[57] ABSTRACT

A pressure converter for mounting above the drill bit on a drill pipe for generating a higher fluid pressure in a portion of a drilling fluid flow, comprises a piston moveable in a cylinder. The piston has a large piston area and an opposite small piston area, which provides an increased pressure in a smaller portion of the drilling fluid flow. A valve arrangement controls the drilling fluid flow to and from the cylinder. A high pressure conduit with a check valve connects the space in front of the small piston area to a header conduit for drilling fluid at the increased pressure. The piston also has another large piston area facing oppositely of the first large piston area and being adapted to be influenced by the drilling fluid pressure in the drill pipe so as to move the piston in an opposite direction. Another small piston area facing oppositely of the first small piston area, is adapted to provide an increased drilling fluid pressure upon piston movement in the opposite direction.

3 Claims, 3 Drawing Sheets

PRESSURE CONVERTER

BACKGROUND OF THE INVENTION

1. Field of the Invention

This invention relates to an improved design of a pressure amplifier or pressure converter for mounting above the drill bit at the lower end of a drill pipe for deep drilling, in particular for oil and gas, and for generating an increased fluid pressure by utilizing energy in a drilling fluid flow downwards through the drill string and the drill pipe. This can be done for the purpose of obtaining an enhanced drilling effect, preferably by means of one or more high pressure jets adapted to have a cutting effect in a surrounding rock formation.

2. Description of the Related Art

The invention can be considered as a further development and improvement of structures described in Norwegian patent specifications Nos. 169.088, 171.322, 171.323 and 171.325. It has now been found that these and other known pressure converters advantageously can be replaced by or modified into new and improved designs to be described in the following description. These new designs involve among other things, an increased yield with respect to delivered amount of drilling fluid at increased pressure.

SUMMARY OF THE INVENTION

Like the pressure converters according to the above Norwegian patent specifications, the present invention as a starting point takes an embodiment comprising a reciprocating piston which is moveable under the influence of drilling fluid pressure, between opposite end positions in a cylinder. At one side the piston has a relatively large piston area which during piston movement in a first direction is influenced by the drilling fluid pressure in the drill pipe, and an oppositely facing, relatively small piston area, which during piston movement in the first direction generates an increased pressure in a smaller portion of the drilling fluid flow. Valve means control the drilling fluid flow to and from the cylinder with the piston, through conduits which communicate with drilling fluid flow passages within the drill pipe and the annulus outside the drill pipe, where the drilling fluid has a relatively low pressure. A high pressure conduit with a check valve connects the space in front of the small piston area to a header conduit for drilling fluid at the increased pressure.

What is novel and specific to the pressure converter according to the invention in the first place is that the piston is provided with another relatively large piston area facing oppositely in relation to the first mentioned large piston area and adapted to be influenced by the drilling fluid pressure in the drill pipe for moving the piston in another, opposite direction of said first direction. There is further provided a second, relatively small piston area facing oppositely in relation to the first mentioned small piston area and being during piston movement in the other, opposite direction, adapted to generate an increased drilling fluid pressure, a second high pressure conduit with a second check valve serves to connect the space in front of the second, opposite small piston area, to the header conduit.

BRIEF DESCRIPTION OF THE DRAWINGS

The novel structural solutions according to the invention as well as additional advantages and particular features thereof, shall be explained more closely in the following description with reference to the drawings, where.

DESCRIPTION OF THE PREFERRED EMBODIMENTS

Since the present pressure converter as far as the main features thereof are concerned, is closely related to corresponding structures according to the Norwegian patent specifications referred to above, it seems sufficient here only briefly to discuss these main features and functions.

Figure 1:
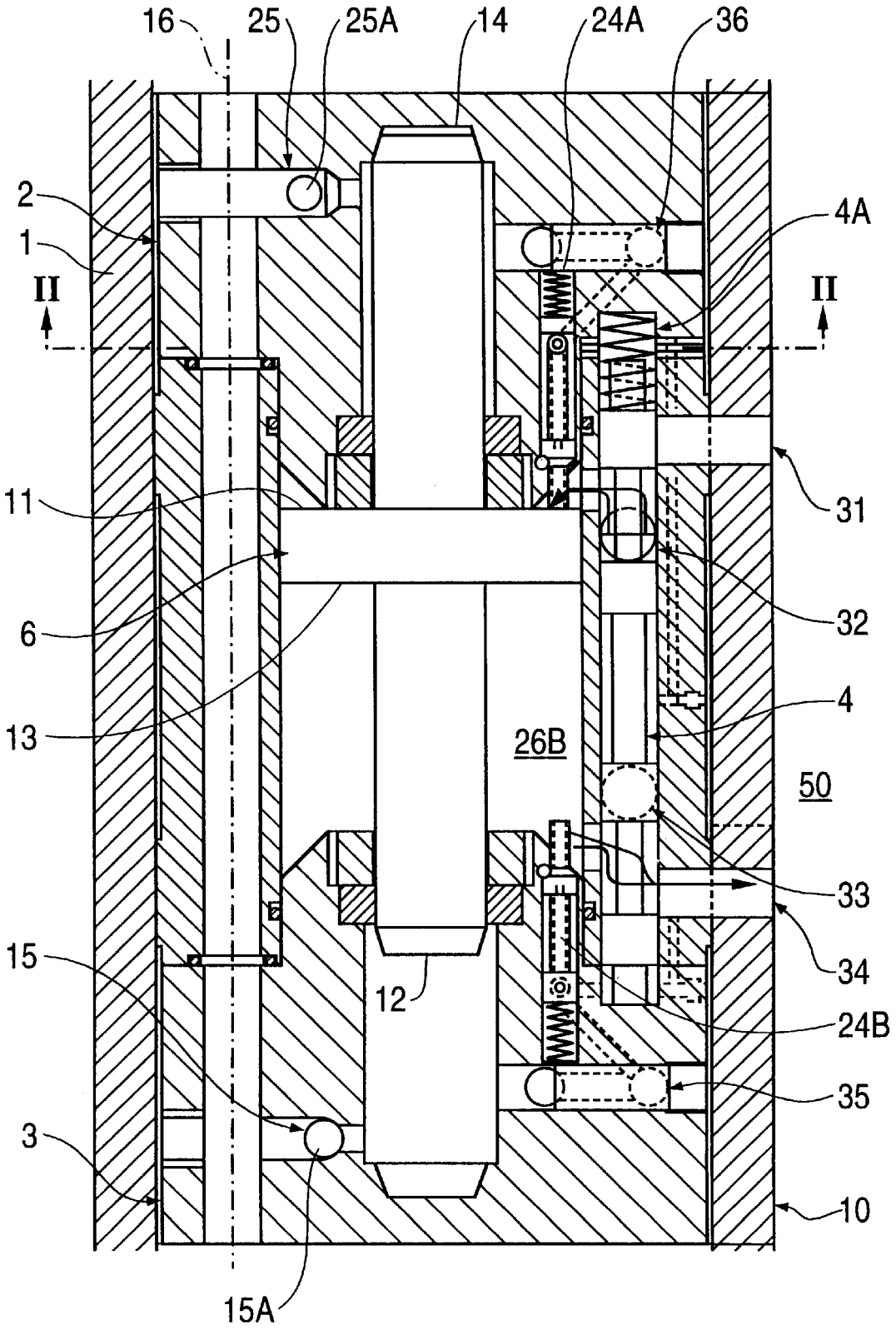
FIG. 1 in longitudinal section (I—I in FIG. 2) shows a first embodiment of a pressure converter according to the invention, with the piston in an upper end position.

As in the previously proposed structures the embodiment of FIG. 1 comprises as substantially cylindrical housing 1, 2, 3 adapted to enclose a piston 6. This has several active piston areas, i.e. in the first place an upper relatively large piston area 11, a second large piston area 13 and an opposite, relatively small piston area 12 at the lower end of piston member 6. This is adapted to be freely moveable axially under the influence of varying drilling fluid pressures at the respective piston areas.

The space or volume in front of piston area 11 can be designated low pressure space, whereas the volume in front of piston area 12 correspondingly can be designated high pressure space. This latter space is connected through a conduit 15 with a check valve 15A, to a header conduit 16 for the resulting drilling fluid flow at an increased pressure. Conduit 16 runs through the whole longitudinal direction of the housing, i.e. the cylinder wall 1, for the purpose of interconnecting several of these pressure converter units to a group.

In addition to the main part of piston 6 with the two relatively large piston areas 11 and 13 as well as the high pressure piston 12, the embodiment of FIG. 1 has an extension upwards ending at a second, relatively small piston area 14 which is facing oppositely in relation to said first small piston area 12. During piston movement upwards caused by piston area 13 upon application of drilling fluid from the drill pipe against it, there is accordingly delivered drilling fluid at an increased pressure through a second high pressure conduit 25 with an associated check valve 25A leading forward to the header conduit 16 mentioned above. Thus the pressure converter will have a working stroke both upwardly and downwardly, so that a return stroke without an actual pressure increasing effect as in the previously known designs referred to above, does not occur. Apparently this involves a substantially enhanced yield.

In order to control the drilling fluid into and out of the cylinder for driving the piston 6 upwards and downwards as explained above, the embodiment of FIG. 1 shows valve means adapted to be influenced by the large piston areas 11 and 13 at the respective end positions of the piston. This valve means comprises two auxiliary slides 24A and 24B being displaceable in associated bores in parallel to the cylinder axis. In the position shown in FIG. 1 the auxiliary slide 24A is pushed upwards by piston area 11. The auxiliary slide 24B then is located in an upper position resulting from spring loading, and has its end portion 26B projecting a small distance into the space in front of piston area 13.

In the position of FIG. 1 drilling fluid under pressure from an inlet 32 via auxiliary slide 24A is directed to the end of a main valve with slide 4, which is thereby pushed to a lower position, and opens for drilling fluid through the inlet opening 32, so that the pressure from this inlet acts against piston area 11. Then a downward piston movement can be initiated, since the space at the underside of the piston has now through the main valve been connected to an outlet 34 to the annulus 50.

When the piston arrives at its lowermost position the piston area 13 will act on the end portion 26B of auxiliary slide 24B, so that this is reset and in turn admits drilling fluid pressure from an inlet 35 onto the lower end of main slide 4 so that this is repositioned to an upper position against the effect of a return spring in bore 4A at the upper end of slide 4. Accordingly the drilling fluid pressure is applied to the underside of piston 6 against piston area 13, and a piston movement upwards is initiated. The space at the upper side of piston 6 then communicates with a return port or outlet opening 31 to the annulus 50.

Thus, like the valve arrangements described in the previous Norwegian patents referred to above, the valve means described here will provide for the desired reciprocating piston movement in the cylinder.

Figure 2:
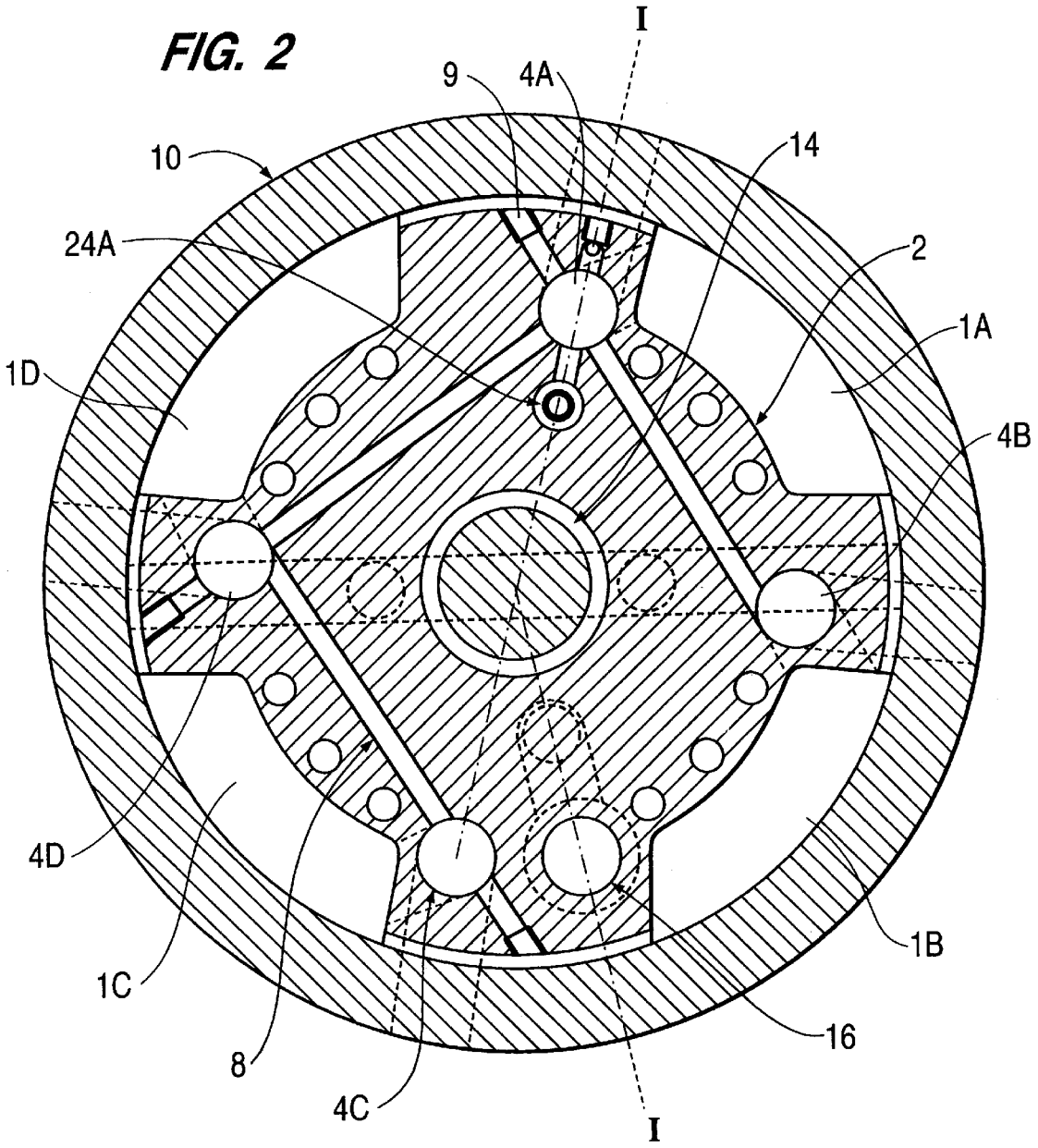
FIG. 2 shows a cross-section along the lines II—II in FIG. 1, and FIG. 3 in longitudinal section shows another embodiment of the pressure converter according to the invention, with the piston in an upper end position.

The cross-sectional view in FIG. 2 shows the drill pipe 10 and the cylinder member 2 which has recesses so as to form flow passages 1A, 1B, 1C and 1D for the drilling fluid flow through the drill pipe past the whole cylinder 1, 2, 3. FIG. 2 shows the bore 4A for the main valve or slide 4 as shown in FIG. 1. Besides there are shown corresponding bores 4B, 4C and 4D for a total of four main valves which all operate synchronously and can be controlled by the same two auxiliary slides 24A and 24B, or there can be provided individual auxiliary slides or auxiliary valves for each of the main valves 4A, 4B, 4C and 4D. For this cooperation between the valves FIG. 2 shows communication channels represented by conduit 8. For supplying drilling fluid under pressure from said passages 1A–D there is shown for valve arrangement 4, 4A with associated auxiliary slide 24A, an opening 9 communicating with passages 1A and 1D. Corresponding openings can also be provided for one or more of the other main valves.

Figure 3:
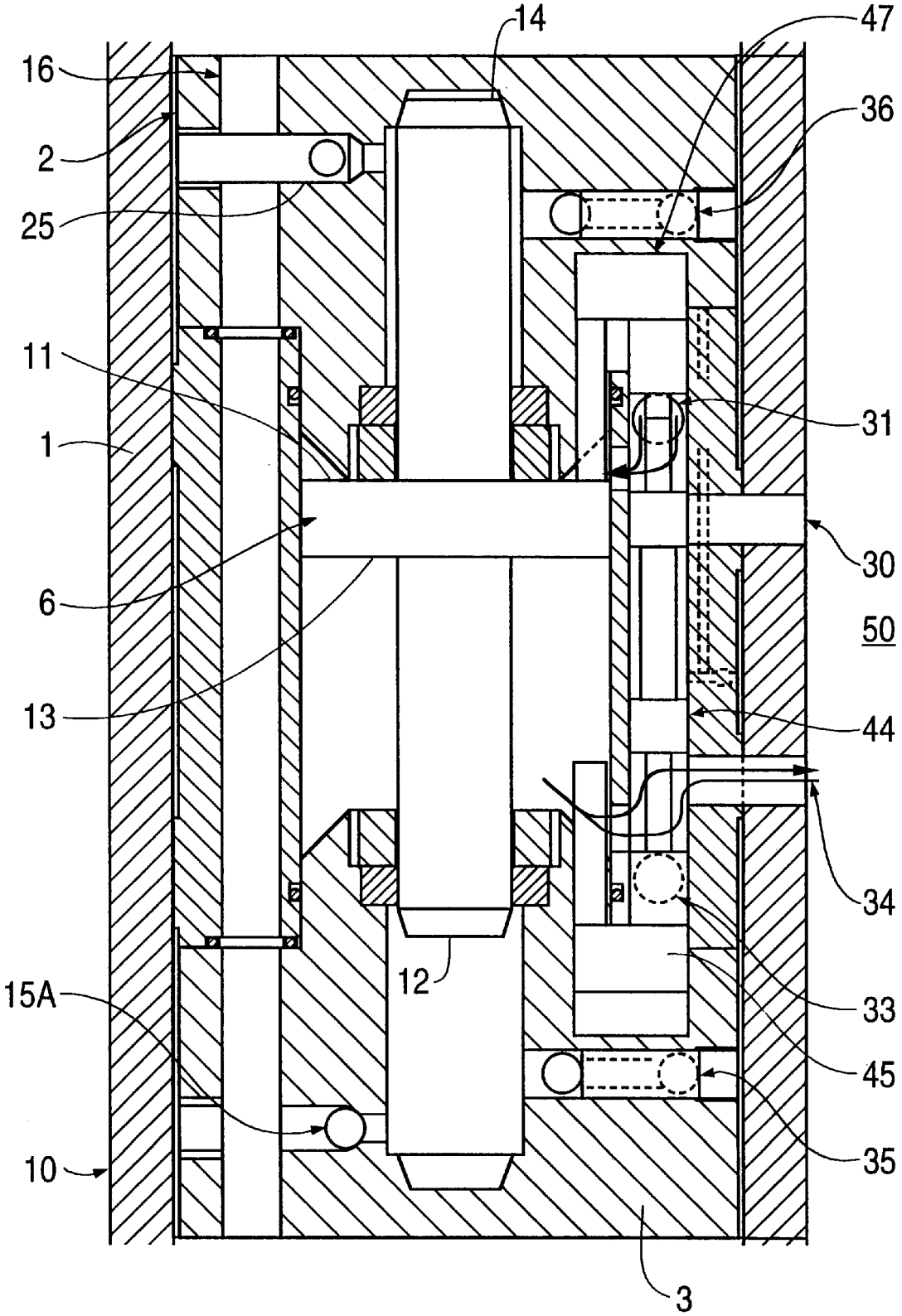

While the valve arrangement according to the embodiment of FIGS. 1 and 2 employs drilling fluid pressure for repositioning the main valve, the valve arrangement according to the embodiment of FIG. 3 is based on direct mechanical action from piston 6 for moving a main valve slide 44 having quite corresponding functions as slide 4 in FIG. 1. At its lower end the main slide 44 has an extension with a transverse member 45 which in turn has an extension part 46 adapted to project into the space in front of piston area 13 in the upper position of slide 44. This position of the valve arrangement is provided for by the upper, large piston area 11 on piston 6, which in FIG. 3 has pushed up an extension 48 which through a transverse member 47 is connected to the upper end of slide 44. Accordingly this will be repositioned in synchronism with the movement of piston 6, i.e. this piston movement is controlled by the valve arrangement. In FIG. 3 there are shown pressure inlets 33 and 36 as well as return ports or outlets 30 and 34, corresponding to those shown in FIG. 1. Inlet 35 supplies drilling fluid to the high pressure side or cylinder in front of piston area 12.

Also in FIG. 3 there can be provided more than one main valve or slide 44, and each such main slide advantageously is spring loaded in a corresponding manner as the main valve slide 4 in FIG. 1, in such a sense that appropriate starting from stand-still will be secured.

In addition to the advantage of larger capacity in the embodiments shown here, namely in the form of an essentially doubled volume flow of drilling fluid at increased pressure, the effective design length of each pressure converter unit is much shorter than in previously known designs having the same capacity. This apparently is very important when several pressure converter units shall be assembled into a group, which is common in practice. In certain respects the embodiment of FIG. 3 is preferred over the one in FIG. 1, in so far as the valve mechanism in FIG. 3 is simpler and operates more directly. In both embodiments it will be convenient to provide for a certain retainment of the main slides in the end positions, which can take place by means of a spring loaded ball or the like (not shown), so that displacement of the slide is avoided during the stroke of piston 6.

What is claimed is:

1. A pressure converter for mounting above a drill bit at a lower end of a drill pipe for deep drilling, and for generating an increased fluid pressure by utilizing energy in a drilling fluid flow downwards through the drill pipe and an associated drill string, comprising:

a reciprocating piston which under the influence of drilling fluid pressure is moveable between opposite end positions in a cylinder, said piston having on one side a first relatively large piston area which during piston movement in a first direction is influenced by the drilling fluid pressure in the drill pipe, and an oppositely facing, first relatively small piston area which during the piston movement in the first direction generates an increased pressure in a smaller portion of the drilling fluid flow;

a valve arrangement for controlling the drilling fluid flow to and from the cylinder, through conduits which communicate with drilling fluid flow passages within the drill pipe and an annulus outside the drill pipe, where the drilling fluid has a relatively low pressure; and a first high pressure conduit with a check valve for connecting the space in front of the first relatively small piston area to a header conduit for drilling fluid at the increased pressure, wherein the piston is provided with a second relatively large piston area facing oppositely in relation to the first relatively large piston area and adapted to be influenced by the drilling fluid pressure in the drill pipe for moving the piston in another, opposite direction of said first direction, there is further provided a second relatively small piston area facing oppositely in relation to the first relatively small piston area, which during piston movement in the other, opposite direction generates an increased drilling fluid pressure, and a second high pressure conduit with a second check valve serves to connect the space in front of said second relatively small piston area to said header conduit.

2. The pressure converter according to claim 1, wherein said valve arrangement is located substantially radially and laterally of the piston.

3. The pressure converter according to claim 1, wherein the operation of the valve arrangement is based on translational valve movement in a direction that is parallel to the axis of the cylinder.

* * * * *